United States Patent [19]

Denis et al.

[11] Patent Number: 5,012,743

[45] Date of Patent: May 7, 1991

[54] HIGH-PERFORMANCE PROJECTILE

[75] Inventors: Jean-Paul Denis, Grace-Hollogne; Marc Neuforge, Aywaille, both of Belgium

[73] Assignee: Fabrique National Herstal, en abrege FN, societe anonyme, Herstal, Belgium

[21] Appl. No.: 446,538

[22] Filed: Dec. 5, 1989

[30] Foreign Application Priority Data

Dec. 5, 1988 [BE] Belgium ..... 8801362

[51] Int. Cl.[5] ..... F42B 12/74; F42B 12/76

[52] U.S. Cl. ..... 102/514; 102/516; 102/517

[58] Field of Search ..... 102/501, 514–517, 102/518

[56] References Cited

U.S. PATENT DOCUMENTS

| | | | |
|---|---|---|---|
| 1,053,845 | 2/1913 | Mauser | 102/516 |
| 2,120,913 | 6/1938 | Studler | 102/516 |
| 3,357,357 | 12/1967 | Voss | 102/516 |
| 3,911,820 | 10/1975 | Canon | 102/514 |
| 4,338,862 | 7/1982 | Kwatnoski et al. | 102/516 |
| 4,517,897 | 5/1985 | Kneubuhl | 102/514 |
| 4,517,898 | 5/1985 | Davis et al. | 102/514 |
| 4,603,637 | 8/1986 | Snede et al. | 102/517 |

FOREIGN PATENT DOCUMENTS

| | | | |
|---|---|---|---|
| 1428690 | 1/1969 | Fed. Rep. of Germany . | |
| 1428692 | 4/1969 | Fed. Rep. of Germany . | |
| 1349178 | 12/1963 | France . | |
| 2142861 | 2/1973 | France . | |
| 9800 | 4/1915 | United Kingdom | 102/514 |
| 437152 | 10/1935 | United Kingdom | 102/514 |

*Primary Examiner*—Harold J. Tudor

*Attorney, Agent, or Firm*—Foley & Lardner

[57] ABSTRACT

Low-recoil projectile with high stopping power, essentially made of at least two components, i.e. a hollow casing (2) made of a hard material and a core (3) made of a rigid material having a lower density than the casing (2) characterized in that the proportions of the lengths of the constituent parts of the projectile are: for the head (4), between 1.5 and 3 times the caliber dimension, for the cylindrical part (5) between 0.7 and 2 times the caliber dimension, and for the rear conical part (6) between 0 and 1 times the caliber dimension, the ratio l/d (length versus caliber dimension) being situated between 2 and 3 and the center of gravity (7) of the projectile being situated in said cylindrical part of the projectile.

11 Claims, 1 Drawing Sheet

HIGH-PERFORMANCE PROJECTILE

BACKGROUND OF THE INVENTION

1. Field of the Invention

The present invention concerns a low-recoil, high stopping power projectile. The invention is applicable to all calibers of hand-held or infantry weapons.

2. Brief Description of the Related Art

It is known that the stopping power of a projectile is inherent to its ability to dissipate a maximum of energy in a minimum of time upon impact of the target.

It is also known that the kinetic energy of a projectile, at a given distance, is given by the equation:

$$Ec = \frac{m\ Vr^2}{2}$$

in which:

m=mass of the projectile

Vr=residual projectile velocity at the given distance.

Thus, Ec is directly proportional to the mass and the square of the residual velocity of the projectile. Furthermore, it is known that weapon recoil is detrimental to the aiming of the weapon, and therefore negatively affects the accuracy of the succeeding round, the ability to fire by bursts and the psychology of the marksman.

Recoil value is specified by the recoil impulse:

$$Ir = Vo(m \times 1.75c)$$

in which

Vo=weapon muzzle velocity m=mass of the projectile c=powder charge

Thus, the recoil impulse is directly proportional to both the mass and the muzzle velocity of the projectile.

The equations discussed above that the requirement of an elevated Ec is fundamentally incompatible with a low Ir.

OBJECTS AND SUMMARY OF THE INVENTION

The projectile of the present invention is intended to minimize this incompatibility.

Additionally, the present invention is intended to provide a projectile with high stopping power and a design that eliminates deformation and disintegration of the projectile upon impact on a soft target.

The invention relates to a low-mass projectile which makes it possible to obtain a low recoil impulse and at the same time to enhance the stopping power at any range of fire, rapid dissipation of kinetic energy within the target without deformation or disintegration.

The projectile makes it possible to obtain these advantages through its geometry and, in particular, the ratio 1/d (length versus caliber, which, favourably, will be superior to 3.

In the projectile according to the invention, that the proportions of the lengths of the constituent elements of the projectile are: for the head, between 1.5 to 3 times the caliber dimension; for the cylindrical part, between 0.7 to 2 times the caliber dimension, and for the rear conical part, between 0 to 1 times the caliber dimension. The ratio 1/d (length versus caliber dimension) is between 3 and 6 and the center of gravity of the projectile is located in the cylindrical part of the projectile. The design of the projectile produces optimum aerodynamic characteristics.

BRIEF DESCRIPTION OF THE DRAWINGS

In order to better explain the characteristics of the invention, the following embodiments are described by way of example, without limitation in any way, with reference to drawings, in which.

DETAILED DESCRIPTION OF THE PREFERRED EMBODIMENTS

Figure 1:
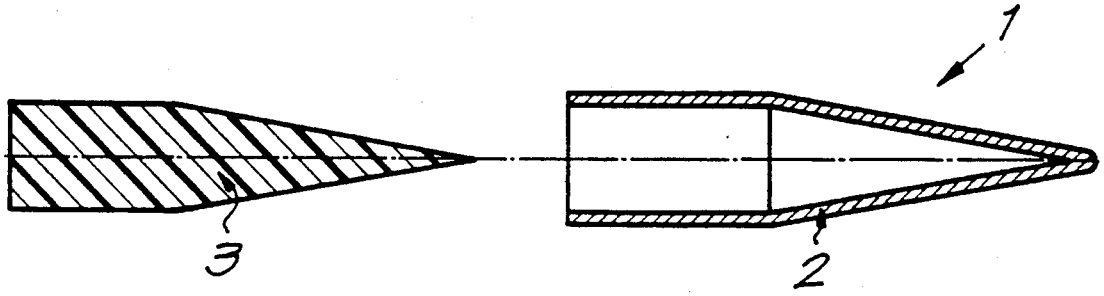
FIG. 1 shows a longitudinal section of an exploded view of the constituent elements of a projectile according to the invention.
Figure 2:
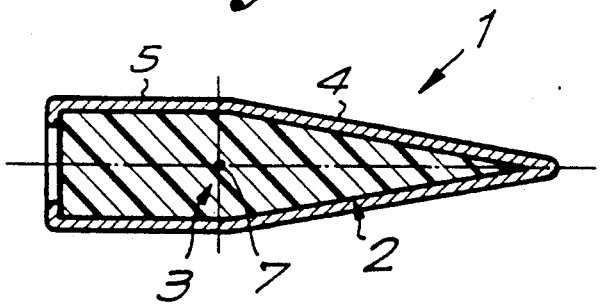
FIG. 2 also shows a longitudinal section of a projectile according to the invention.
Figure 3:
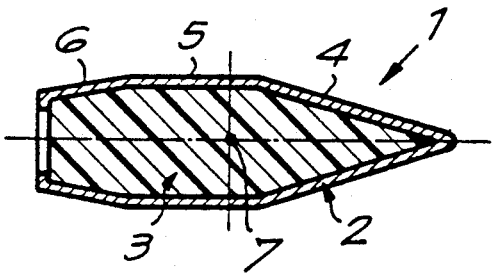
FIG. 3 shows a variant of FIG. 2.

As shown in the drawings, the projectile 1 is largely made up of two elements: the casing 2 and the core 3. The casing 2 is hollow and is made of a hard material, for example a copper alloy, steel or a similar material.

The casing has a mass per unit volume between 20 to 100N/dm$^3$. The core 3 is made of a rigid material with a lower density than the casing, such as a high-density plastic, for example polycarbonate, polyamide etc., and is possibly filled with glass fibres or pellets or similar elements. The core has a mass per unit volume between 5 to 20N/dm$^3$. The core 3 can be made of one or several pieces that may or may not be rigidly fitted together. In this way, a projectile with a low m/s ratio is obtained. The shape of the projectile achieves optimum aerodynamics and makes it possible to maintain the high residual velocities. This aerodynamic optimization of the projectile reduces the loss of speed on the trajectory, and requires a smaller powder charge to achieve the required velocities. Therefore, the optimization contributes to the reduction of the recoil impulse. Using a core 3 made of a material, as specified above, prevents deformation of the projectile within soft targets. The combination of a casing 2 made of a hard material and a core 3 made of a material having a lower density than the casing 2, i.e. a lighter materials, causes the bullet to tip in a soft body. The tipping results in the rapid loss of stability of the projectile, while maintaining a considerable penetrating power due to its high velocity and its rigid structure.

By way of example and without limitation for a projectile according to the present invention with a 5.56 mm caliber, the characteristics would be:

mass between 1.5 and 2 g ratio 1/d:4.5+/−0.5 head 4: 2.5 times the caliber+/−0.5 times the caliber cylindrical part 5: 1.5 times the caliber+/−0.5 times the caliber;

rear cone 6: 0.5 times the caliber+/−0.5 times the caliber to be combined within the limits of 1/d.

In this example, the center of gravity 7 will be situated in the cylindrical part 5, at a distance between 0 and 4 mm from the connection with the head. The core 3 can be composed of two or more parts, mounted in line and possibly rigidly fitted together in one way or other.

The present invention is in no way limited to the embodiments described by way of example and shown in the accompanying drawings; on the contrary, numerous modifications are possible within the scope of the invention.

Thus, the core 3 can be composed of two or more parts, mounted in line and possibly rigidly fitted together in one way or other.

We claim:

1. A projectile comprising:

a hollow casing (2) having a tapered head portion and a cylindrical portion, the casing being formed of a hard material having a density and having an overall length and a caliber dimension, the ratio of the overall length and caliber dimension being between 3 and 6;

a core (3), inserted within the casing, the whole core being formed of a rigid high density plastic material having a lower density than the density of the casing material;

the head portion (4) of the projectile having a length between 1.5 and 3 times the caliber dimension;

the cylindrical portion (5) of the projectile having a length between 0.7 and 2 times the caliber dimension and being connected to the head portion;

the projectile further having a center of gravity (7) situated in the cylindrical portion.

2. A projectile amending to claim 1, including:

a rear conical portion (6) on the projectile having a length no longer than the caliber dimension.

3. A projectile according to claim 1, wherein the center of gravity (7) is situated in the cylindrical portion between 0 and 4 mm from the connection of the cylindrical portion (4) to the head portion (4).

4. A projectile according to claim 1, wherein the casing (2) has a mass per unit volume between 20 to $100N/dm^3$.

5. A projectile according to claim 1, wherein the core (3) has a mass per unit volume between 5 to $20N/dm^3$.

6. A projectile according to claim 1, wherein the casing (2) is made of metal.

7. A projectile according to claim 1, wherein the core (3) is made of polycarbonate.

8. A projectile according to claim 1, wherein the core (3) is made of polyamide.

9. A projectile according to claim 1, wherein the plastic material is filled with glass fibers.

10. A projectile according to claim 1, wherein the plastic material is filled with pellets.

11. A projectile according to claim 1, wherein the core (3) is made in one piece.

* * * * *

UNITED STATES PATENT AND TRADEMARK OFFICE

CERTIFICATE OF CORRECTION

PATENT NO. : 5,012,743

DATED : May 7, 1991

INVENTOR(S) : Jean-Paul DENIS and Marc NEUFORGE

It is certified that error appears in the above-identified patent and that said Letters Patent is hereby corrected as shown below:

Column 1, line 31, delete "Ir=Vo(mx1.75c)" and insert in lieu thereof --Ir=Vo(m+1.75c)--.

Signed and Sealed this

Sixth Day of October, 1992

*Attest:*

DOUGLAS B. COMER

*Attesting Officer*

*Acting Commissioner of Patents and Trademarks*